United States Patent [19]

Blum

[11] Patent Number: 4,485,529

[45] Date of Patent: Dec. 4, 1984

[54] REUSABLE TYING DEVICE

[76] Inventor: Ronald D. Blum, 838 Orchard Rd., SW., Roanoke, Va. 24014

[21] Appl. No.: 504,942

[22] Filed: Apr. 8, 1983

[51] Int. Cl.[3] ..... F16G 11/00

[52] U.S. Cl. ..... 24/117; 24/119; 24/128; 36/50

[58] Field of Search ..... 24/16 R, 16 PB, 17 B, 24/30.5 R, 30.5 P, 115 R, 117, 119, 120, 121, 122, 128, 129 R, 129 D, 140, 457, 488, 530, 532, 545, 546; 36/50, 136

[56] References Cited

U.S. PATENT DOCUMENTS

| | | | |
|---|---|---|---|
| 500,497 | 6/1893 | Hathaway | 24/120 |
| 528,464 | 10/1894 | Craig | 24/119 |
| 537,934 | 4/1895 | Patton | 24/119 X |
| 565,884 | 8/1896 | Emmons | 24/120 X |
| 878,129 | 2/1908 | Downer | 24/120 |
| 1,221,656 | 4/1917 | Benson | 24/119 |
| 1,371,637 | 3/1921 | Meredith | 24/120 |
| 2,175,962 | 10/1939 | Kenifick | 24/128 R |
| 4,270,247 | 6/1981 | Freedom | 24/30.5 P X |
| 4,403,375 | 9/1983 | Blum | 24/119 X |

*Primary Examiner*—William E. Lyddane
*Assistant Examiner*—James R. Brittain
*Attorney, Agent, or Firm*—Lalos, Leeds, Keegan, Lett, Marsh, Bentzen & Kaye

[57] ABSTRACT

A tying device for shoelaces which can be attached to the shoe and serves to maintain tied laces in their disposition. The device includes a body portion which remains exposed for viewing by the public and an eyelet member which receives the laces for securing the device to the shoe. An elastic band is integrated with the body portion and eyelet member for stretching over a shoelace knot to lock the device in place and prevent the shoelaces from becoming untied.

21 Claims, 8 Drawing Figures

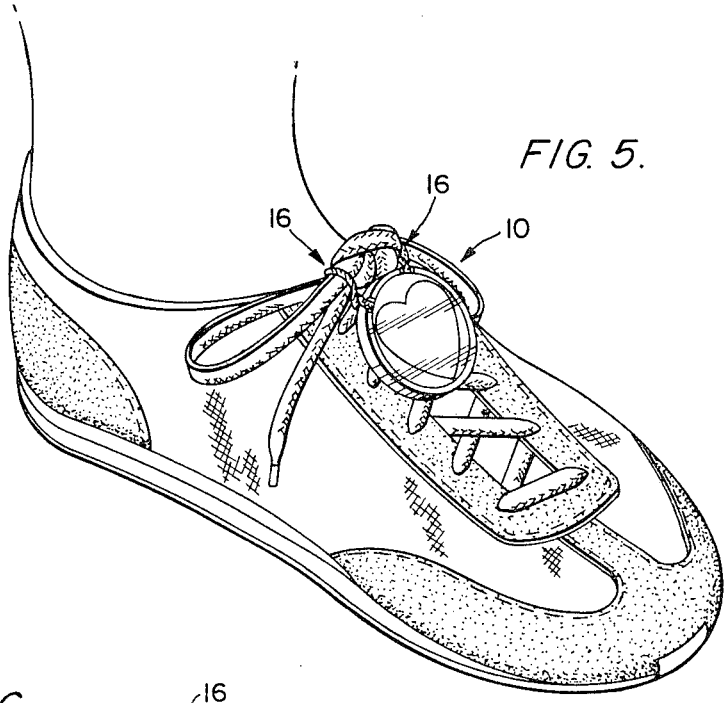
FIG. 5.
FIG. 6.
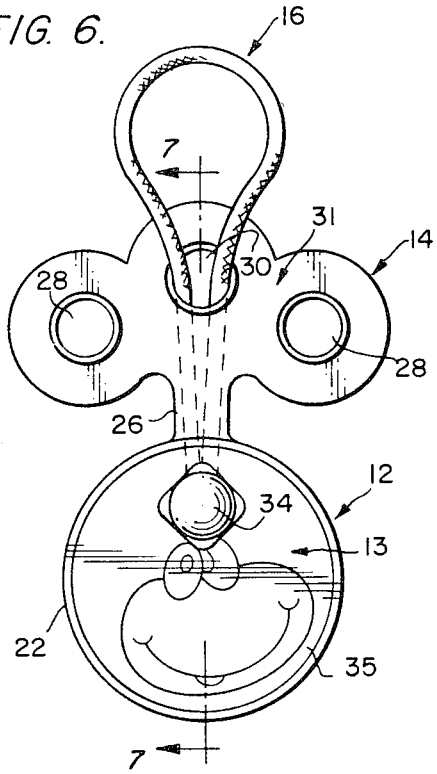
FIG. 7.
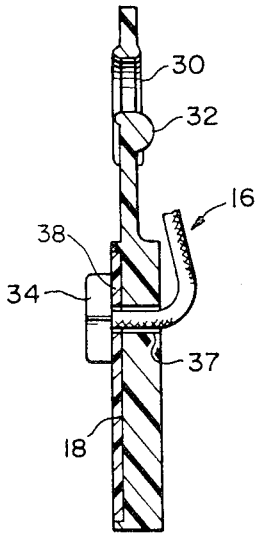

REUSABLE TYING DEVICE

BACKGROUND AND DISCUSSION OF THE INVENTION

A problem with shoe laces or any types of laces which are used to tie ends of materials together is that they may often become undone requiring the shoe wearer to stop whatever activity he or she is embarked on and to retie the shoelaces. With children in their play activities this places a certain burden on their parents and other adults around them, in sports activities it can actually stop play altogether or require a player to be removed from the game until his shoelaces are properly tied. In other sports loose or untied shoelaces may cause the athlete to lose his concentration and adversely affect performance.

Although devices have existed previously to prevent shoelaces from becoming untied, they have suffered from a number of problems which has detracted from their acceptance by the general public. These devices are often cumbersome, extremely complicated and costly. Because of the time it takes to secure the device to the shoe and the laces it is simply not worth the effort. Furthermore, the device may not be configured to remain on the shoe when the shoes are untied for storage or other nonuse, requiring special storage effort to prevent loss. In addition, many resuable devices are simply so cumbersome they are unacceptable in the market place regardless of their utility.

Although disposable devices have become available, some users simply prefer to have a reusable device, because it may be more economical, more appealing to the eye and generally more acceptable in the market place.

The invention described herein overcomes many of the problems discussed above. The invention relates generally to a reusable device designed to work on all shoelaces and of any type of material. Preferably the device is one which can work on all different types of shoes whether they have eyelets or not and can remain on the shoes even after laces are untied, providing a convenient method of retaining the device on the shoes for reuse.

The device is relatively thin in design creating a low profile which is generally acceptable to the consuming public. Portions of the device grasp the shoelace once tied so that the lace knot is clearly exposed for view. Elastic material on the device grasps the knot from the sides and holds the shoelaces in place adjacent to the knot to prevent the knot and shoelaces from becoming untied. The device can be described as having two portions, a body portion and an eyelet member. The body portion of the device is designed to receive a medallion which enhances display of advertising or other artistic material. The body portion also serves to cooperate with the elastic band to create a torque causing the medallion to be pulled flat against the shoe and thus making it cosmetically pleasing to the purchasing public.

The manner in which this tension is created is by way of the elastic band being attached to the front of the body portion of the device directly beneath the medallion cover. In addition, the elastic band extends through an elastic band hole in the eyelet member, the latter being displaced from the body portion. When the elastic is pulled through the band hole, over the knot and over the body portion, it retracts about a neck portion separating the eyelet member and the body portion to secure the knot.

BRIEF DESCRIPTION OF THE DRAWINGS

FIG. 5 is a perspective view of the device of FIGS. 1 through 4 when secured to a shoe.

FIG. 6 is a front view of another embodiment of the tying device of the invention.

FIG. 7 is a cross-sectional view of the device shown in FIG. 6 taken along lines 7—7.

DETAILED DESCRIPTION OF THE PREFERRED EMBODIMENT

Figure 1:
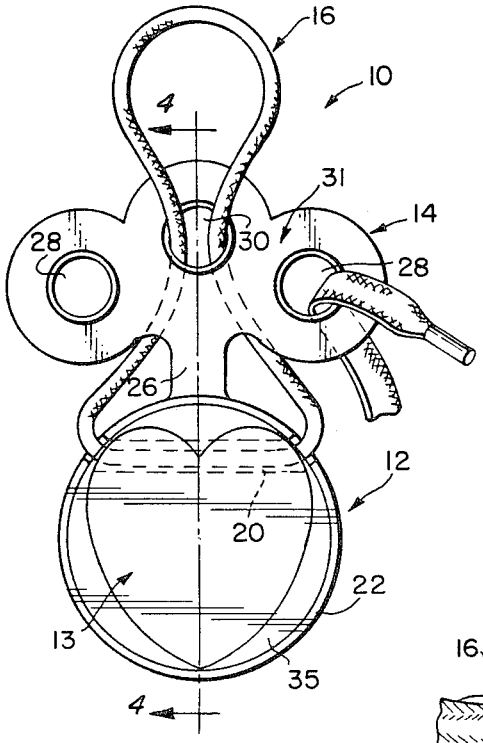
FIG. 1 is a front view of a preferred embodiment the tying device of the invention.

As can be seen from FIG. 1, the device 10 is generally comprised of two basic portions, a body portion 12 and a tying or eyelet member 14, the latter of which serves as a means for securing device 10 to the shoe. An elastic band 16 is secured to body portion 12 and is dimensioned to permit the elastic band to be stretched over shoelace knots, looped over body portion 12 to maintain the laces in a tied disposition. Body portion 12 has a front face 13 for exposure and a rear face 15 which faces the shoe when device 10 is secured to the shoe. Front face 13 includes a recessed area 18 which extends substantially throughout the entire surface of the body portion except for rim 22 which completely circumscribes recess 18 as shown. Where the body portion 12 is circular in configuration as shown in FIGS. 1 through 4 recess 18 extends throughout the front face 13 at a constant depth to rim 22 which extends substantially entirely about the periphery of body portion 12.

Figure 2:
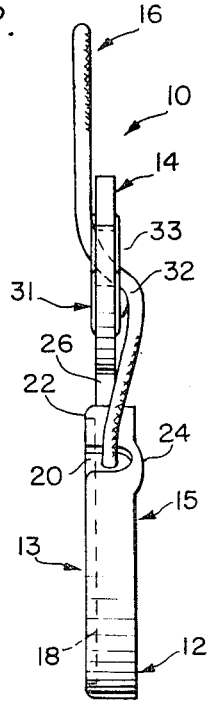
FIG. 2 is a side view of the device shown in FIG. 1.
Figure 4:
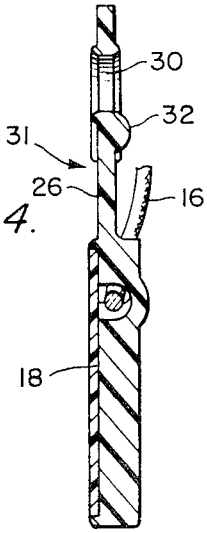
FIG. 4 is a cross-sectional view of the device as shown in FIG. 1 taken along lines 4—4.

Slot 20 as can best be seen in FIGS. 1, 2 and 4, extends entirely across the front surface of the body portion 12 and is cut through the rim 22 permitting a part of elastic band 16 to be placed in slot 20 and extend out of body portion 12 through slot holes formed in rim 22. In this embodiment slot 20 is formed along a cord of the device parallel with a center line of the body portion 12. Slot 20 has a depth greater than half the thickness of body portion 12 as can be seen in FIG. 2. Because of this depth there is provided a reinforced portion 24 along rear face 15 of body portion 12 to reinforce what otherwise would be weakened portion.

Figure 3:
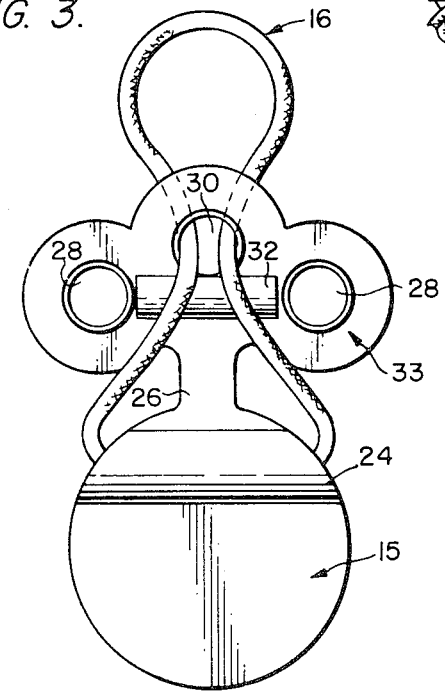
FIG. 3 is a rear view of the device shown in FIG. 1.

Tying member 14 is connected to body portion 12 by a relatively narrower width neck portion 26 extending radially from body portion 22 preferably perpendicularly to the center line of slot 20. In this preferred embodiment member 14, body portion 12 and neck portion 26 are of unitary structure made from the same plastic material. The tying member 14 includes two eyelets 28 spaced from one another on either side of neck portion 26 equidistantly and about the same radial distance from the center of body portion 22. An elastic band hole 30 is located intermediate the two eyelets 28 equidistantly but at a greater radius from the center of the body portion 12. As can been seen from FIGS. 2 and 4 tying member 14 has a thickness less than that of body portion 12 which in this embodiment is about one half ($\frac{1}{2}$) that of body portion 12. Because of the number of holes located in this relatively thin tying member, a reinforced portion 32 is provided on the tying member in addition to the one provided on the body portion 12. This reinforced portion 32 as can be seen in FIG. 3 includes raised material extending between the two eyelets 28 beneath the elastic band hole 30.

In addition to acting as reinforcement, portion 32 enhances the torque on body portion 12 when device 10 is attached to a shoe. As can be seen in FIG. 2, the exposed surface of portion 32 is rounded to permit sliding movement of band 16 thereover, particularly during stretching and other operations of band 16. Portion 32 further extends sufficiently beyond rear face of member 14 such that when the device is properly secured to a shoe a torque will be imposed to force body portion 12 against the shoe in a relatively flat disposition.

It should be noted from the side view of FIGS. 2 and 4, tying member 14 has a front face 31 nearly coplanar with the front face 13 of the recessed area 18 on body portion 12. As a result of the difference in thickness the center line in FIGS. 2 and 4 passing longitudinally midway between front face 31 and rear face 33 of tying member 14 is offset from the center line passing longitudinally midway betwen front face 13 and rear face 15 body portion 12 and lies closer to the front face 13 of body portion 12 than it does rear face 15. In addition slot 20 has a depth extending beyond this center line of body portion 12. With this configuration, when the device is attached to the shoe in the proper manner a torque or tension is created to maintain the body portion 12 in a position adjacent the front portion of the shoe and relatively flat with respect thereto This can better be appreciated from the discussion of the operation of device 10 which follows.

Body portion 12 carries a cover plate medallion 35 which is dimensioned to fit snugly against inner surface of rim 22 and completely cover recessed portion 18. In this manner, once the elastic band is in place in the slot, the medallion can be adhered to front face 13 of body portion 12. This configuration prevents children or other users from removing the medallion while at the same time providing a means for securing the band portion within the slot 20.

Figure 8:
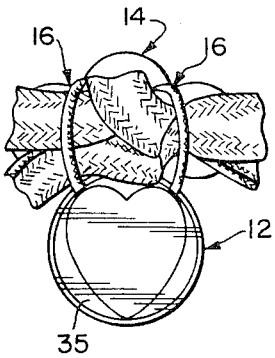
FIG. 8 is a partial front view of the device as shown in FIG. 5.

In operation the device is secured to the shoe by lacing the laces through their respective eyelets 28 so each lace passes through one eyelet. The laces are then tied in a bow knot as usual. This forces the device adjacent to the shoe with a knot above the tying member 14, and the body portion 12 extending below the knot for easy view by the consumer and others. Once the knot has been tied, elastic band 16 as shown extended through the elastic band hole 30 is pulled over the knot, expanded to slip over the body portion 12 and then allowed to retract to the position where it loops around the neck portion 26. In this position the band is under sufficient tension to grasp the knot from the sides thereof to maintain the knot in a tied disposition. The configuration of body portion 12, elastic band 16, tying member 14, and neck portion 26 cooperate to secure elastic band 16 about the knot until it is desired to be released by the user. In this position as secured elastic band 16 grasps the knot in its expanded position to hold the knot in place and prevent the shoelaces from becoming untied. Once band 16 is in this secured or locked position as shown in FIGS. 5 and 8, it pulls or presses the body portion 12 against the front of the shoe as described above as a result of the applied torque.

In another embodiment as shown in FIGS. 6 and 7 band 16 includes at one end a knob member 34 which has an effective diameter larger than that of the hole 37 in body portion 12 through which band 16 is fitted. With this configuration instead of fixing the band through a slot as discussed in connection with the earlier embodiment, the disc or medallion 35 can be placed in the recess 18 with a disc hole 38 communicating with hole 37. Band 16 is then inserted through holes 37 and 38 after the disc-body portion assembly have been completed. Since there is no slot provided, there is no need for a reinforced portion extending along the rear face of body portion 12 as described above. Thus, the differences between this embodiment of FIGS. 6 and 7 and the embodiment described in FIGS. 1 through 5 revolve primarily around the method of attaching the elastic band to the device and the consequential absence of reinforced portions on the device to compensate for slotted or other material having been removed from the device. Other than these differences the devices are essentially identical.

It should be understood that the configurations shown and described herein are merely those of a preferred embodiment. Other configurations such as rectangular portions or portions of artistic design can replace the rather circular disc-like devices shown and described in conjunction with FIGS. 1 through 7. Similarly other configurations can be employed for the tying member to create a mechanism for maintaining the device on the shoe and fixing the device to the laces to impair shoelaces from becoming untied. The above description is of preferred embodiments, and the inventor intends to claim as his inventions all substantial equivalents of features as set out in the claims which follow:

I claim:

1. A device for securing tied shoe laces comprising:

(a) a body portion (b) a member extending from said body portion, said member including means for securing said device to shoe laces; and (c) a closed elastic band fixed to said body portion, said member defining a band hole for receiving said elastic band therethrough, said elastic band being of sufficient dimensions to pass through said hole, over a shoe lace knot, and over said body portion to impede the shoe lace knot from untying.

2. The device according to claim 1 wherein said member includes a raised portion on a rear surface of said member cooperating with said elastic band to increase torque applied to said body portion for maintaining said body portion relatively flat against said shoe.

3. The device according to claim 1 wherein said elastic band is of sufficient dimensions to engage the knot from opposing sides while exposing the knot for view.

4. The device according to claim 3 wherein said band hole in said member is displaced from said body portion, said member defines a neck portion, between said band hole and said body portion, having a width dimension smaller than the corresponding width dimension of said body portion, said neck and body portion width dimensions are of a ratio sufficient to maintain said band constrained about a shoelace knot.

5. The device according to claim 4 wherein said means for securing said device to said shoelaces includes a first and second shoelace eyelets spaced from each other with said band hole therebetween.

6. The device according to claim 5 wherein said member cooperates with said elastic band to provide a torque for maintaining said body portion relatively flat against a shoe when said elastic band is passed through said band hole, over said knot, and over said body portion.

7. The device according to claim 6 wherein said band hole is equally spaced between said lace holes.

8. The device according to claim 7 wherein said body portion is substantially planar in configuration and defines a front face and a rear face, said front face being recessed for receiving a disc member.

9. The device according to claim 8 wherein said recess extends substantially throughout the front face of said body portions and defines a peripheral rim circumscribing said recess about the periphery of said body portion.

10. The device according to claim 9 wherein said elastic band is attached by a knob member to said disc.

11. The device according to claim 9 wherein said front face defines a slot for receiving a portion of the elastic band, said slot extending entirely across said device and through said peripheral rim.

12. The device according to claim 11 further comprising means for reinforcing said body portion in the vicinity of said slot.

13. The device according to claim 12 wherein said means for reinforcing said slot includes a raised portion of material on the rear face of said body portion opposite said slot.

14. The device according to claim 13 further comprising means for reinforcing said member.

15. The device according to claim 14 wherein said member includes a front face and a rear face, said means for reinforcing said member includes a raised portion on the rear face of said member between said two lace holes.

16. The device according to claim 15 further comprising a disc member secured to said body portion within said recess portion with a part of said elastic band in said slot.

17. The device according to claim 16 wherein said body portion is circular in configuration.

18. The device according to claim 17 wherein said body portion is rectangular in configuration.

19. The device according to claim 17 or 18 wherein said body portion and member are of unitary structure made of the same plastic material.

20. The device according to claim 19 wherein said band hole is displaced a greater distance from said body portion than said lace holes.

21. The device according to claim 20 wherein the thickness of said member is less than that of said body portion to enhance the torque imposed on the body portion when the device is secured in place about a knot.

* * * * *